US007952053B2

(12) United States Patent
Mills et al.

(10) Patent No.: US 7,952,053 B2
(45) Date of Patent: May 31, 2011

(54) MIRRORED STYLING IRON

(76) Inventors: Jennifer Mills, Plainfield, IL (US); Scott Mills, Plainfield, IL (US)

( * ) Notice: Subject to any disclaimer, the term of this patent is extended or adjusted under 35 U.S.C. 154(b) by 827 days.

(21) Appl. No.: 11/953,991

(22) Filed: Dec. 11, 2007

(65) Prior Publication Data

US 2008/0257372 A1 Oct. 23, 2008

Related U.S. Application Data

(60) Provisional application No. 60/912,183, filed on Apr. 17, 2007.

(51) Int. Cl.

| | |
|---|---|
| ***H05B 3/16*** | (2006.01) |
| ***H05B 3/26*** | (2006.01) |
| ***A45D 1/04*** | (2006.01) |
| ***A45D 6/18*** | (2006.01) |
| ***A45D 2/40*** | (2006.01) |

(52) U.S. Cl. ..... 219/225; 132/223; 132/224; 132/269

(58) Field of Classification Search ..... None
See application file for complete search history.

(56) References Cited

U.S. PATENT DOCUMENTS

| | | | | |
|---|---|---|---|---|
| 2,383,967 | A | 9/1945 | Hernon | |
| 4,267,430 | A * | 5/1981 | Downey | 219/222 |
| 5,203,456 | A * | 4/1993 | Boswell | 206/349 |
| 6,119,702 | A | 9/2000 | Habibi | |
| 6,173,718 | B1 | 1/2001 | Okumoto et al. | |
| 6,223,753 | B1 | 5/2001 | Lo | |
| 6,622,735 | B2 | 9/2003 | Hirata et al. | |
| D493,916 | S | 8/2004 | Ceva | |
| 6,840,639 | B2 | 1/2005 | Zadro | |
| RE38,713 | E | 3/2005 | Habibi | |
| 6,895,975 | B2 | 5/2005 | Hafemann | |
| 7,131,739 | B2 | 11/2006 | Sellgren et al. | |
| 2004/0045570 | A1 | 3/2004 | Yao | |
| 2005/0252519 | A1 | 11/2005 | Kayser | |
| 2006/0037625 | A1 | 2/2006 | Kayser et al. | |
| 2006/0150996 | A1 | 7/2006 | Lun et al. | |
| 2006/0201527 | A1 | 9/2006 | Higgins et al. | |

OTHER PUBLICATIONS

International Searching Authority/US, PCT International Search Report, International Application No. PCT/US07/87427, Jul. 25, 2008.

* cited by examiner

*Primary Examiner* — Joseph M Pelham
(74) *Attorney, Agent, or Firm* — Beem Patent Law Firm

(57) ABSTRACT

A device for enhancing vision for a hair curling iron for conventional curling iron of the general type having clamping members, two heating members, two bases and two styling members wherein the improvement comprises a mirror element attached to one of the bases. In another embodiment, a styling iron comprising an upper body having inner and outer surfaces, an upper cover attached to the upper body, a heating element between the upper cover and the inner surface, a lower body operationally attached to the upper body, the lower body having inner and outer surfaces, a lower cover attached to the lower body, a second heating element between the lower cover and the inner surface of the lower body, and a mirror attached to the outer surface of the upper body. Moreover, the styling iron may further comprise an insulating element between the heating element and the mirror.

15 Claims, 4 Drawing Sheets

MIRRORED STYLING IRON

This application claims the benefit of priority from U.S. Provisional Application 60/912,183, filed Apr. 17, 2007.

BACKGROUND OF THE INVENTION

1. Field of the Invention

The present invention is directed to the field of hair styling devices, particularly to straightening or curling irons of both personal and professional varieties.

2. Description of the Related Art

Variations of electric straightening and curling irons have been on the market for years. When used at home, the end user has typically been forced to put the iron down and in a second and separate step, pick up a mirror to view the results. This is time consuming, and because the iron is still hot, the act of putting it down may burn other objects such as clothing or present a fire hazard.

There are numerous styling irons shown in the prior art. Most of these reflect variations in the styling surfaces, such as interlocking plates or nonlinear surfaces to allow for styling flexibility. For example, U.S. Pat. No. 6,223,753 to Lo discloses a styling iron having various interchangeable styling surfaces such as flat, triangular, curved or wave surface for styling hairs into various shapes.

Other modifications in the field of styling irons have related to combining various methods of heating hair to obtain different effects. U.S. Reissue Pat. No. RE38,713 to Habibi discloses a hair styling apparatus that combines both dry heat through the use of heating plates with "wet" heat via the application of steam to hair. U.S. Pat. No. 6,895,975 to Hafeman combines a straightening iron with a device for crimping hair.

Still further adaptations have related to attempts to make styling irons more ergonomically comfortable. For example, U.S. Pat. No. 7,178,532 to Kayser discloses a flat iron for styling hair comprising head portions with heatable inner surfaces that may be pivotally positioned and locked relative to the handle portions for increased user comfort and control.

In spite of all of these advancements, it is still necessary for a user to put down the iron or rely on additional means in order to determine the extent and progress of styling. It would be desirable to create a novel styling iron that overcomes one or more shortcomings in the prior art.

BRIEF SUMMARY OF THE INVENTION

It is an object of the present invention to provide a styling iron, such as a curling or straightening iron, having a mirror or reflection surface to enable the user to see the results of the curling iron without having to put the iron down.

It is a further object of the present invention to provide the user of an iron the ability to immediately see the results of the curling process without having to pick up a mirror or other reflecting item.

In accordance, in one embodiment, the invention is a device for enhancing vision for a hair styling iron for convention styling of the general type having clamping members, two heating members, two bases and two styling members wherein the improvement comprises a mirror element attached to one of the bases.

In another embodiment, the invention is a device for enhancing vision for a hair styling iron of the general type having clamping members, two heating members, two bases and two styling members wherein the improvement comprises two mirror each elements attached to one of the bases.

In still another embodiment, the invention may be a styling iron comprising an upper body having an inner surface and an outer surface, an upper cover attached to the upper body, a heating element between the upper cover and the inner surface of the upper body, a lower body operationally attached to the upper body, the lower body having an inner surface and an outer surface, a lower cover attached to the lower body, a second heating element between the lower cover and the inner surface of the lower body, and a mirror attached to the outer surface of the upper body. The mirror may be of a thickness to be effective in the application, for example, between about 0.05 mm thick and about 4 mm thick, may be made of glass, plastic or another suitable material. In addition, the outer surface of the upper body may have a recess, and the mirror may be located within the recess to lay generally flush with the outer surface of the upper body. Alternatively, or in addition, the styling iron may have at least one pressing bar having tabs, wherein the mirror may be positioned between the outer surface of the upper body and the at least one pressing bar, the at least one pressing bar having tabs for engaging slots in the upper body to hold said mirror in place. Moreover, the styling iron may further comprise an insulating element between the heating element and the mirror. The insulating element may be between about 1 mm thick and about 5 mm thick and may be made of a silicon-based material.

In yet another embodiment, the styling iron may comprise a second mirror attached to an outer surface of the lower body. Both mirrors may provide for reflection to improve use and visibility, and at least one of the mirrors may be configured to provide for both reflection and magnification. In this embodiment, the styling iron may additionally comprise a second insulating element between the second heating element and the second mirror.

DETAILED DESCRIPTION

Figure 1:
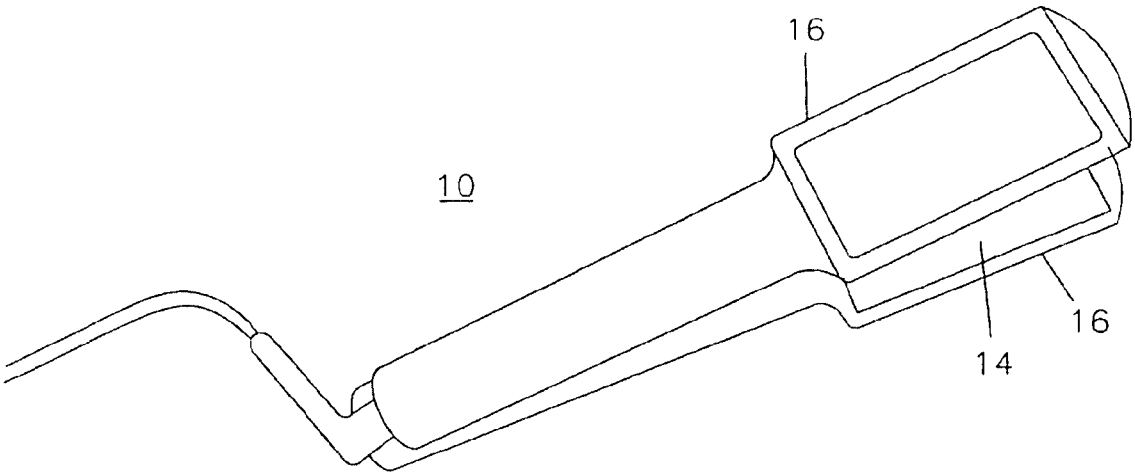
FIG. 1. is an isometric view of one embodiment of the inventive styling iron.
Figure 2:
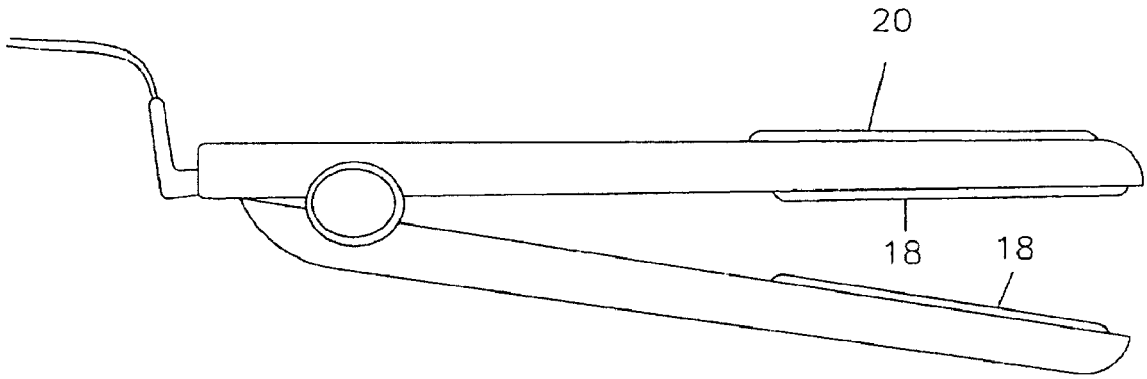
FIG. 2. is side perspective view of the styling iron of FIG. 1.

Referring to FIGS. 1-2, in one embodiment, the present invention may comprise a conventional styling iron 10 of the general type having clamping members 12, two heating members 14, two bases 16, and two styling members 18. The two heating members are respectively fixed in an inner side of a front portion of each (an upper and a lower) clamping member, and the two bases 16 are respectively fixed on the two heating members. The curling iron of this embodiment is conventional.

The critical and novel feature of this embodiment of the invention is the inclusion of a mirror 20 on the side of the base 16, opposite the heating elements. The inclusion of the mirror permits the end user to look at the results of the styling iron without having to put the iron down and/or use a separate mirror.

Figure 3:
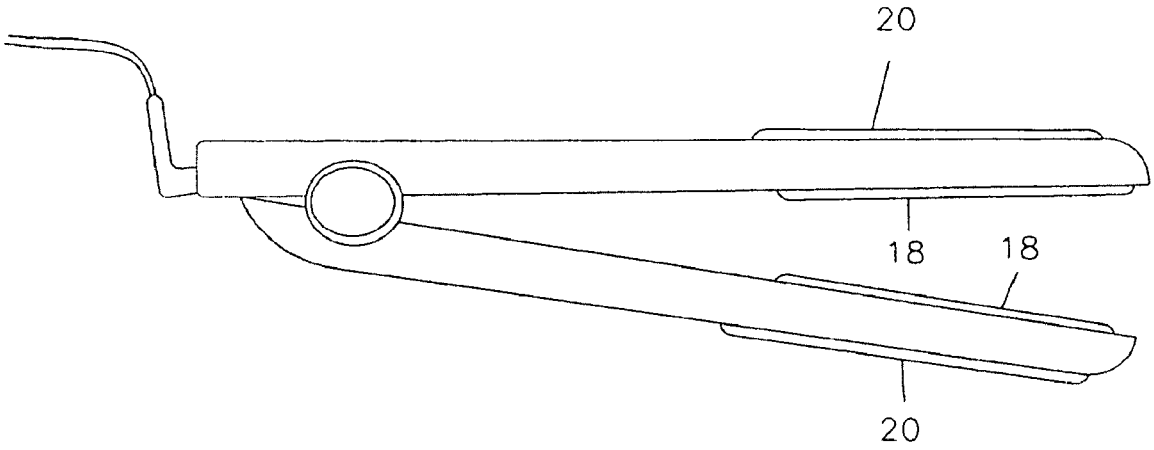
FIG. 3. is another embodiment of the present inventive styling iron.

In another embodiment, as shown in FIG. 3, the iron has two mirrors 20, affixed to opposing sides of each respective base.

Figure 4:
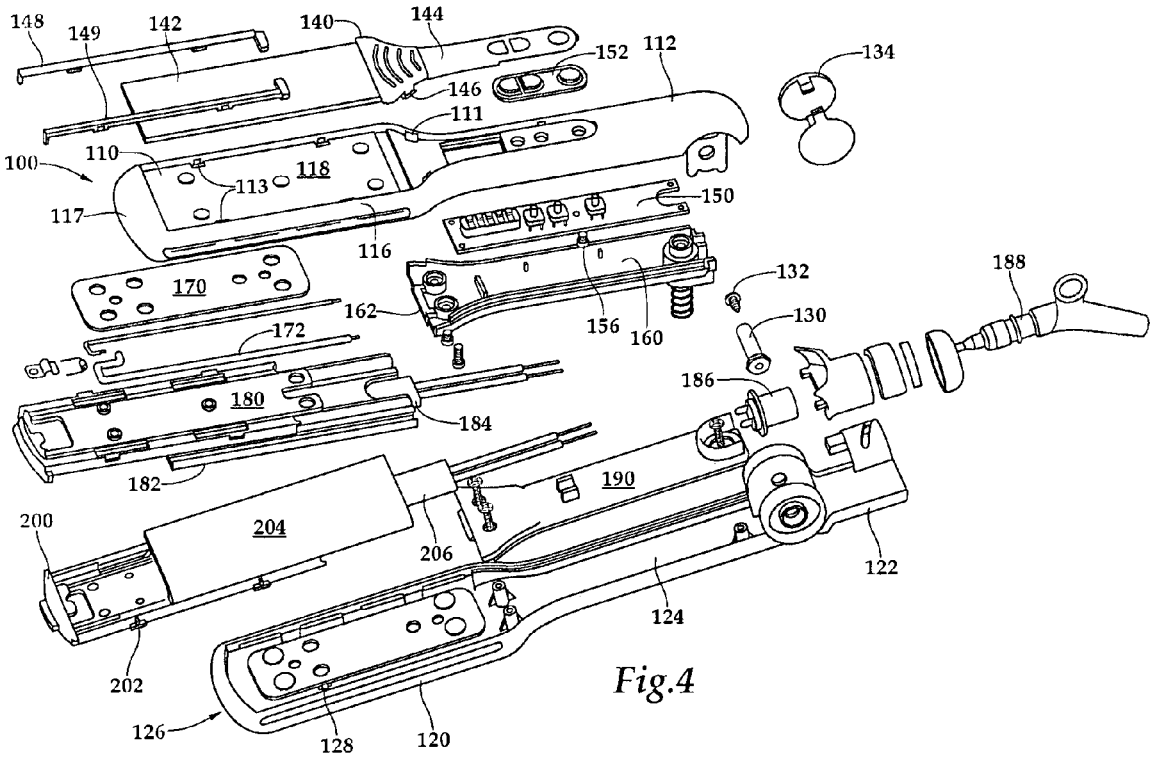
FIG. 4. is an exploded view of still another embodiment of the present inventive styling iron

In still another embodiment, as shown in FIG. 4, the styling iron 100 may comprise an upper body 110 operatively connected to a lower body 120. Upper body 110 and lower body 120 may be made of materials and using methods generally known in the art, e.g., by molding plastic or metal. Upper body 110 and lower body 120 may be between about 1 mm and about 5 mm thick, preferably between about 2 mm and about 4 mm thick. A proximal portion 112 of upper body 110 may be hinged to a proximal portion 122 of lower body 120 through use of a hinge element 130 that may be held in place with a screw 132 or other fastening device. Hinge element 130 may then be covered with an end cover 134.

Upper body 110 may have an inner surface 114 and an outer surface 116. Upper body 110 may comprise at least one button 152 attached to a circuit board 150 for controlling styling iron 100. Button 152 may protrude through inner surface 114 to outer surface 116 or may be on outer surface 116 to engage with elements on circuit board 150 that protrude through inner surface 114 to outer surface 116. Circuit board 150 may be sandwiched between upper body 110 and upper vise body 160 and held in place with fasteners 156. Fasteners 156 may extend through upper body 110, upper vise body 160 and, preferably, circuit board 150 to prevent circuit board 150 from moving when styling iron 100 is in use.

Styling iron 100 may further comprise an upper vise cover 180 spaced inwardly from upper body 110 and proximate a distal end 162 of upper vise body 160. Upper vise cover 180 may receive a styling body 182 operationally attached to a heating element 184. In the embodiment shown in FIG. 4, styling body 182 comprises a generally flat plate for straightening hair. Heating element 184 may be attached to socket 186, which is operationally connected to a power cord 188, to receive electricity.

Styling iron 100 may comprise a mirror portion 140 that may be affixed to a distal end 117 of outer surface 116 and may comprise, for example, a mirror 142, or a mirror 142 and additional accent pieces 144. Outer surface 116 may have a recessed area 118, such that mirror portion 140 may be inserted into recessed area 118 to seat generally flush with outer surface 116 or to remain recessed from outer surface 116. Mirror portion 140 may be attached to upper body using any one or more of various means generally known in the art. As shown in FIG. 4, mirror portion 140 may have tabs 146 with upper body 110 having corresponding slots 111 to fasten mirror portion 140 to upper body 110. Styling iron 100 may also comprise at least one pressing bar 148 for clamping mirror portion 140 to upper body 140. Pressing bar 148 may have a plurality of tabs 147 for insertion into slots 113 of upper body 110. As shown in FIG. 4, styling iron 100 may have two generally symmetrical pressing bars 148, 149. Mirror portion 140 and upper body 110 may also have at least one hole (not shown) to receive at least one fastener (not shown) to fasten mirror portion 140 to upper body 100, or upper body 110 may have a groove (not shown) to receive a mating tongue (not shown) of mirror portion 140 and hold mirror portion 140 in place.

Mirror 142 may be made of any material or composition that allows for reflection. Mirror 142 may be a reflective surface such as a polished or shiny surface and may be made of metal, such as stainless steel or aluminum, or mirror 142 may comprise a generally transparent body 143 having a reflective coating 145 applied to at least one side of the generally transparent body 143. Generally transparent body may be made of a plastic material or, preferably, may be made of glass. Mirror 142 may be of a thickness to be effective in the application, for example, between about 0.05 mm and about 4 mm, preferably between about 1 mm and about 3 mm, still more preferably about 1.5 mm.

Styling iron 100 may further comprise an insulating element 170 proximal inner surface 114 and between inner surface 114 and heating element 184. Insulating element 170 may be necessary to protect mirror 142 from deforming, melting or otherwise being affected by the heat generated by styling iron 100 and may further protect a user from heat that may be transferred through the mirror 142. Insulating element 170 may comprise any material thick enough to protect mirror 142 from heat, while, preferably, not significantly adding to the thickness of styling iron 100. Insulating element 170 may be affixed to upper body 110 and/or upper vise cover using any conventional means, for example, by fastening insulating element 170 to upper body 110, upper vise cover 180 or both. Alternatively, insulating element 170 may be adhesively fixed to upper body 110 and/or upper vise cover 180, or insulating element 170 and upper body 110 and/or upper vise cover 180 may have corresponding protrusions and recesses to hold insulating element 170 in place. Styling iron 100 may further comprise at least one insulation wire 172 that may extend generally around a periphery of insulating element 170, preferably between insulating element 170 and upper vise cover 180, to provide additional insulation and heat protection for mirror 142.

In the embodiment shown in FIG. 4, insulating element 170 may comprise a wafer or series of wafers sandwiched together. Wafers may be made of a silicon-based material, such as silica. If silicon-based wafers are used, preferably between about 1 and about 10 wafers may be used, more preferably between about 3 and about 8 wafers, still more preferably about 5 wafers may be sandwiched together. The silicon-based wafers, in addition to insulating mirror 142 from heat, may also provide shock absorption to protect mirror 142 from cracking during use, for example, by absorbing impact forces that may be generated when setting styling iron 100 on a hard countertop. Insulating element 170 may be of a thickness to be effective in the application, for example, between about 0.05 mm and about 5 mm thick, preferably between about 1 mm and about 5 mm thick, still more preferably about 3 mm thick.

Lower body 120 of styling iron 100 may be generally similar to upper body 110. Lower body 120 may have an inner surface 124 and an outer surface 126. Proximal portion 122 of lower body 120 may be attached to a lower vise body 190 using fasteners or other means. In one variation, circuit board 150 may be housed between lower body 120 and lower vise body 190 instead of between upper body 110 and upper vise body 160. In another variation, a second circuit board 154 may be housed between lower body 120 and lower vise body 190.

A lower vise cover 200 may be attached to lower body 120 in a manner similar to the connection between upper vise cover 180 and upper body 110. For example, lower vise cover 200 may be fastened to lower body 120; lower vise cover 200 and lower body 120 may have mating tabs 202 and slots 128; or lower vise cover 200 may have a tongue (not shown) to fit in a mating groove (not shown) of lower body 120. As with upper vise cover 180, lower vise cover 200 may be operatively connected to a styling body 204 such as a flat plate for straightening hair, and styling body 204 may be operatively connected to a second heating element 206 for providing heat to styling body 204.

In another embodiment, proximal portion 122 of lower body 120 may also have a recessed area 127 for receiving a second mirror portion 210 having a second mirror 212. Second mirror portion 210 may be attached to lower body 120 in a manner similar to the attachment between first mirror portion 140 and upper body 110 or in any other manner generally known in the art. Second mirror 212 may be similarly sized and shaped to mirror 142, or second mirror 212 may be sized and/or shaped differently. For example, mirror 142 may comprise a flat surface for reflection whereas second mirror 212 may be curved to provide magnification, or vice versa.

If styling iron 100 has second mirror 212 on lower body 120, styling iron 100 may further comprise a second insulating element 220 between second heating element 206 and second mirror 212. Second insulating element 220 may be comprised of a material having similar properties as insulating element 170. Second insulating element 220 may have a thickness similar to insulating element 170, but second insulating element 220 may be thicker than insulating element 170 if lower body 120 will be placed proximate a user's skin during use.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A styling iron comprising:

an upper body having an inner surface and an outer surface;

an upper cover attached to said upper body;

a heating element between said upper cover and said inner surface of said upper body;

a lower body operationally attached to said upper body, said lower body having an inner surface and an outer surface;

a lower cover attached to said lower body;

a second heating element between said lower cover and said inner surface of said lower body;

a mirror attached substantially parallel to said outer surface of said upper body; and an insulating element between said heating element and said mirror, wherein the insulating element has at least two layered wafers to provide shock absorbing protection for the mirror.

2. A styling iron according to claim 1, wherein said mirror is between about 0.05 mm thick and about 4 mm thick.

3. A styling iron according to claim 1, wherein said mirror is made of glass.

4. A styling iron according to claim 1, wherein said mirror is made of plastic.

5. A styling iron according to claim 1, wherein said outer surface of said upper body has a recess and said mirror is located within said recess to lay generally flush with said outer surface of said upper body.

6. A styling iron according to claim 1, said styling iron further comprising:

at least one pressing bar having tabs, wherein said mirror is positioned between said outer surface of said upper body and said at least one pressing bar, said at least one pressing bar having tabs for engaging slots in said upper body to hold said mirror in place.

7. A styling iron according to claim 1, wherein said insulating element is between about 1 mm thick and about 5 mm thick.

8. A styling iron according to claim 7, wherein said insulating element is made of a silicon-based material.

9. A styling iron according to claim 1, further comprising:

a second mirror attached to an outer surface of said lower body; and said second mirror is substantially parallel to said outer surface of said lower body.

10. A styling iron according to claim 9, wherein at least one of said mirror or said second mirror is configured to provide for reflection and magnification.

11. A styling iron according to claim 10, further comprising:

an insulating element between said heating element and said mirror, and;

a second insulating element between said second heating element and said second mirror.

12. A styling iron according to claim 11, wherein said insulating element and said second insulating element are each between about 1 mm thick and about 5 mm thick.

13. A styling iron according to claim 11, wherein said insulating element and said second insulating element are made of a silicon-based material.

14. A device for enhancing vision for a conventional hair styling iron of the general type having clamping members, two heating members, two bases and two styling members wherein the improvement comprises:

a mirror attached substantially parallel to one of the bases; and an insulating element between at least one said heating member and said mirror, wherein the insulating element has at least two layered wafers to provide shock absorbing protection for the mirror.

15. A device according to claim 14, wherein the improvement comprises:

two mirror elements, each attached to a respective one of the bases.

* * * * *